US006102620A

United States Patent [19]

Muramatsu

[11] Patent Number: 6,102,620

[45] Date of Patent: Aug. 15, 2000

[54] RUBBER DAM AND METHOD OF APPLICATION THEREOF

[75] Inventor: Tateo Muramatsu, Yokohama, Japan

[73] Assignee: Bridgestone Corporation, Tokyo, Japan

[21] Appl. No.: 09/227,149

[22] Filed: Jan. 8, 1999

[30] Foreign Application Priority Data

Jan. 13, 1998 [JP] Japan ..... 10-004889

[51] Int. Cl.[7] ..... E02B 7/20

[52] U.S. Cl. ..... 405/115; 405/91

[58] Field of Search ..... 405/115, 91, 114, 405/116, 110, 107, 108, 87, 96

[56] References Cited

U.S. PATENT DOCUMENTS 3,855,800 12/1974 Ganzinotti ..... 405/91
4,662,783 5/1987 Muramatsu et al. ..... 405/115
4,780,024 10/1988 Obermeyer et al. ..... 405/91
5,230,585 7/1993 Fujisawa et al. ..... 405/91
5,318,381 6/1994 Enami et al. ..... 405/91

*Primary Examiner*—Eileen Dunn Lillis
*Assistant Examiner*—Frederick Lagman
*Attorney, Agent, or Firm*—Oliff & Berridge, PLC

[57] ABSTRACT

A rubber sheet is formed in a bag shape, and a seam portion of the bag-shaped rubber sheet is fixed to a summit portion of an overflow dam. When the bag-shaped rubber sheet is expanded, a rubber dam is raised, thereby damming up water and adjusting the amount of running water. Next, when the bag-shaped rubber sheet which has been expanded is contracted and collapsed, the rubber sheet is supported by pipes, which extend substantially horizontally from the summit portion of the overflow dam toward the downstream side at a predetermined distance from each other. For this reason, the rubber sheet hangs down with its own weight and with the weight of water running downstream so as to droop down between the pipes. As a result, a rubber dam that does not bulge at the downstream side is obtained.

20 Claims, 9 Drawing Sheets

RUBBER DAM AND METHOD OF APPLICATION THEREOF

BACKGROUND OF THE INVENTION

1. Field of the Invention

The present invention relates to a rubber dam which traverses a spillway of a dam (movable) or a river, and dams up water and to a method of application thereof.

2. Description of the Related Art

As shown in FIG. 8, an arch rubber dam 30 as a dam which dams up the running of a river and adjusts the amount of running water has been put to practical use.

This arch rubber dam 30 is applied in the following manner. A rubber sheet 32 is doubled up and overlapped so as to form a bag shape. The bag-shaped rubber sheet 32 is placed on an overflow dam 14 which is built on a river bed. A seam portion 32A of the bag-shaped rubber sheet 32 is fixed to the summit portion of the overflow dam 14 by bolts 20 so that the rubber sheet 32 is formed in an arch shape.

When the rubber sheet 32 is curved in an arch shape, due to the difference of curvature, the rubber sheet 32 is strained in the longitudinal direction at the fixed side thereof (at the upstream side). Accordingly, when the rubber sheet 32 is collapsed, a force by which the rubber sheet 32 is contracted toward the upstream side acts upon the rubber sheet 32, and as shown in FIG. 9, the rubber sheet 32 bulges in portions at the downstream side. In this way, if the rubber sheet 32 bulges, when the rubber sheet 32 is collapsed, it may be hit by drift wood or the like, and abrasions or damage may be caused.

When two end portions of the rubber sheet 32 are fixed to side surfaces of fixed dams in this manner, since the rubber sheet 32 bulges along the slope surface of the overflow dam 14, applicability is inferior.

SUMMARY OF THE INVENTION

In view of the aforementioned facts, it is an object of the present invention to provide a rubber dam in which a rubber sheet does not bulge in portions during contraction (collapse) thereof and which has good applicability.

The first aspect of the present invention is a rubber dam that adjusts the amount of running water, comprising: an overflow dam which is built on a river bed; a rubber sheet formed in a bag shape; a fixing portion at which the bag-shaped rubber sheet is fixed to a summit portion of the overflow dam; and supports which support the bag-shaped rubber sheet when it has been collapsed, extending substantially horizontally from the summit portion of the overflow dam toward the downstream side at a predetermined distance from each other in the widthwise direction of the river.

The second aspect of the present invention is a method of application of a rubber dam that adjusts the amount of running water, comprising the steps of: building an overflow dam on a river bed; building supports which support a bag-shaped rubber sheet which has been collapsed, extending substantially horizontally from a summit portion of the overflow dam toward the downstream side, at a predetermined distance from each other in the widthwise direction of the river; and placing the bag-shaped rubber sheet on the supports and fixing the bag-shaped rubber sheet to the summit portion of the overflow dam.

In the present invention, the rubber sheet is formed in a bag shape, and a seam portion of the bag-shaped rubber sheet may be fixed to the summit portion of the overflow dam. Thus, when the bag-shaped rubber sheet is expanded, the rubber dam is raised, damming up water, and adjusting the amount of running water.

When the bag-shaped rubber sheet is contracted and collapsed, the rubber sheet is supported by supports, which extend substantially horizontally from the summit portion of the overflow dam toward the downstream side at a predetermined distance from each other in the widthwise direction of the river. For this reason, the rubber sheet hangs down with its own weight, and with the weight of water running downstream so as to droop down between the supports. Accordingly, the rubber sheet at the downstream side does not bulge.

Further, since the rubber sheet can be placed on the supports and two end portions thereof can be fixed to side surfaces of fixed dams. As a result, applicability can be improved.

Since the present invention is structured as described above, when the rubber sheet is collapsed, the rubber sheet does not bulge at the downstream side. Accordingly, the rubber sheet is not damaged by drift wood or the like. Further, when the rubber sheet is collapsed, because the rubber sheet does not contact the overflow dam or the like, abrasion between the rubber sheet and the overflow dam does not occur.

DESCRIPTION OF THE PREFERRED EMBODIMENTS

Figure 1:
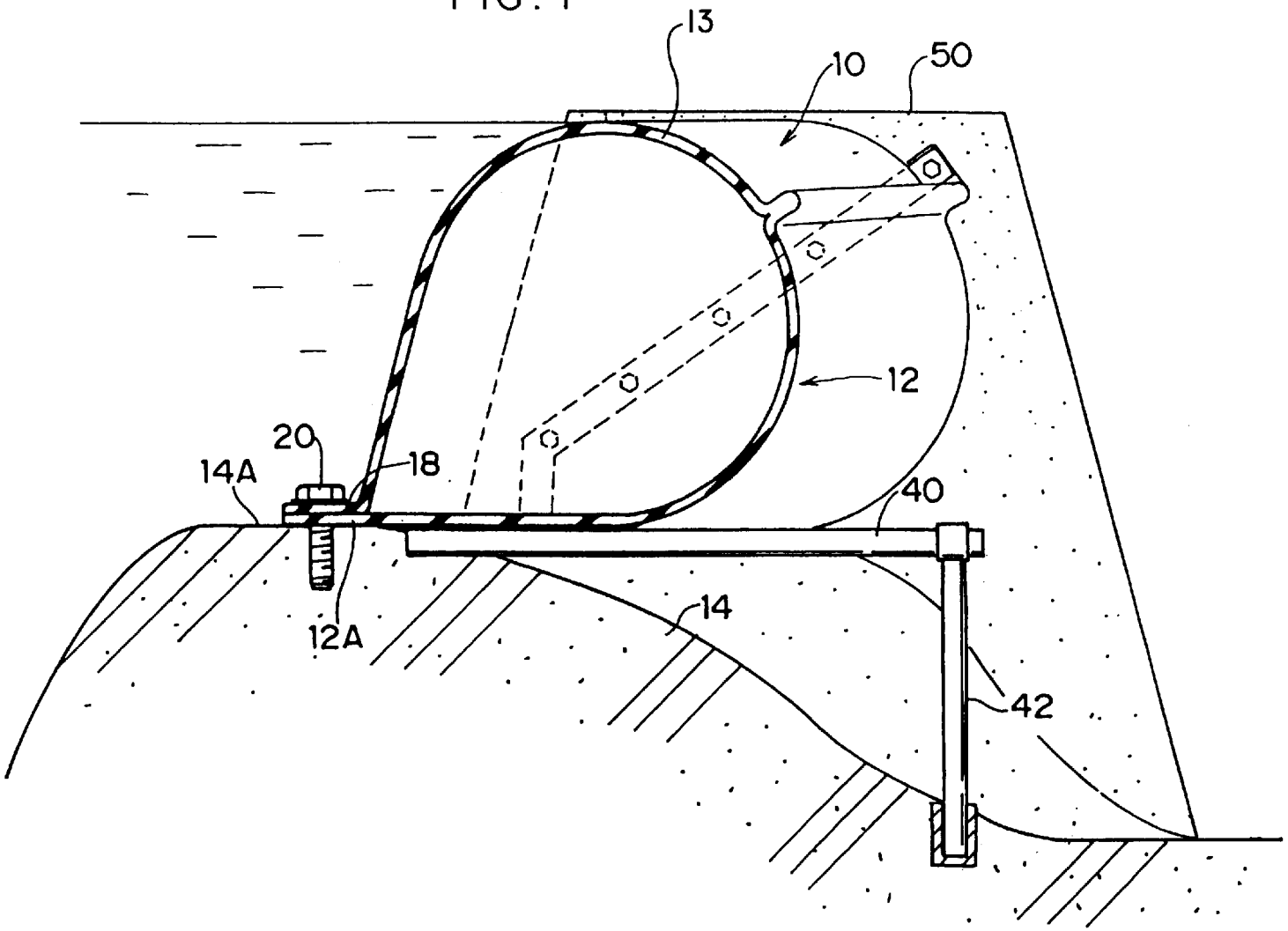
FIG. 1 is a cross-sectional view illustrating a state in which a rubber dam according to an embodiment of the present invention has risen.
Figure 2:
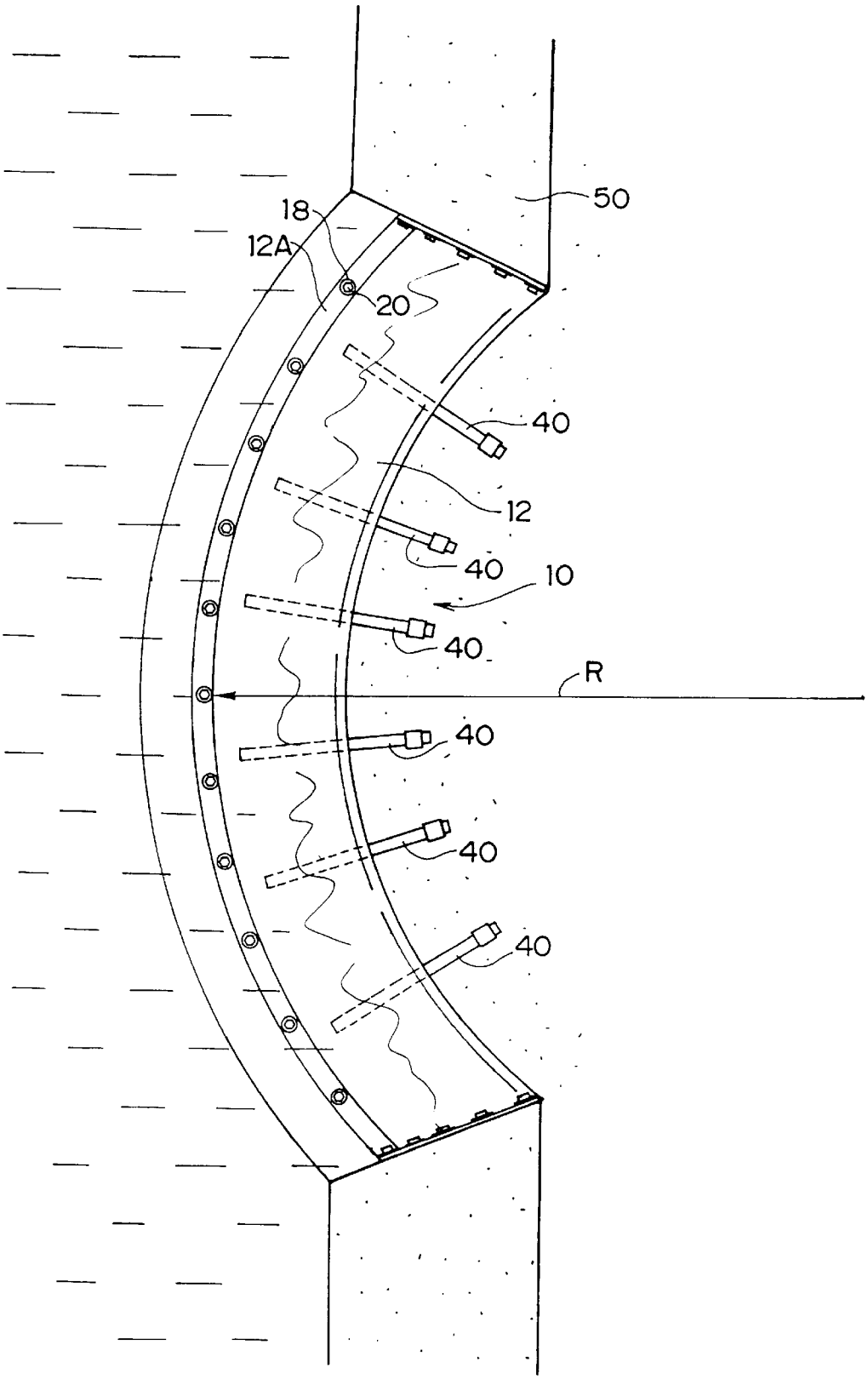
FIG. 2 is a plan view illustrating a state in which the rubber dam according to the present embodiment has risen.
Figure 3:
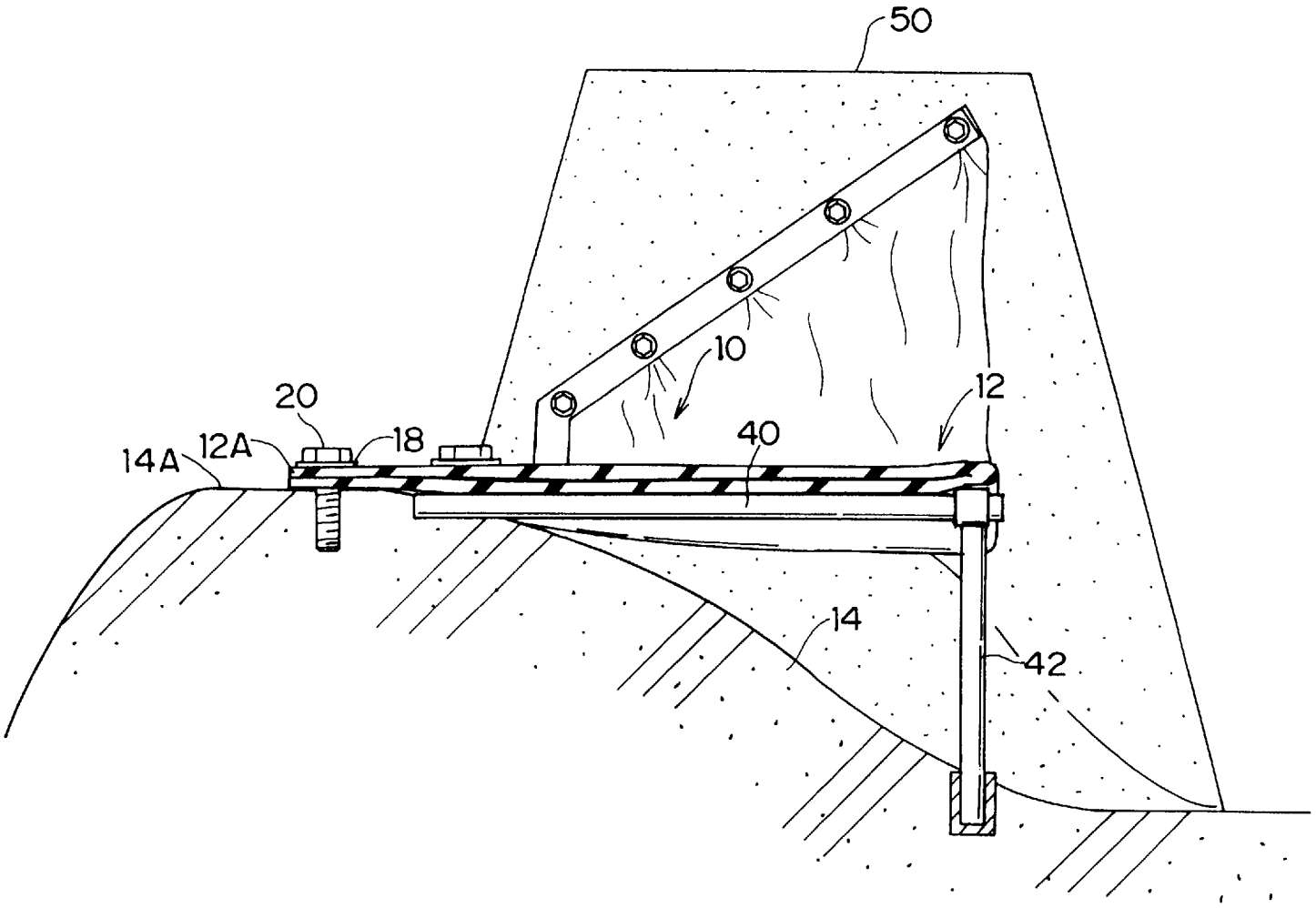
FIG. 3 is a cross-sectional view illustrating a state in which the rubber dam according to the present embodiment has collapsed.

In FIGS. 1 to 5, an arch rubber dam 10 according to an embodiment of the present invention is shown.

The arch rubber dam 10 is structured in such a manner that a strip-shaped rubber sheet 12 is doubled up, and an overlapped seam portion 12A is fixed to a summit portion 14A of an arch shaped overflow dam 14 which is made from concrete and is built on a river bed. A cord 13 may be embedded in the rubber sheet 12 comprising a bias cord or a reinforcement cord.

Bolt holes are formed on the seam portion 12A. These bolt holes are pressed by a plate 18, and the seam portion 12A of the rubber sheet 12 is fixed to the summit portion 14A of the overflow dam 14 by using bolts 20. Further, two end portions of the rubber sheet 12 (at the sides of the banks) are fixed to side surfaces of fixed dams 50 so as to form a bag shape.

A supplying/discharging pipe (not shown) for communicating with an internal portion of the rubber sheet 12 is disposed at the overflow dam 14. Fluid is supplied into the arch rubber dam 10 or is discharged therefrom by this supplying/discharging pipe so as to raise or collapse the arch rubber dam 10.

A plurality of pipes 40 as supports extend horizontally from the summit portion 14A of the overflow dam 14 toward the center of the curvature of the arch, at a fixed distance from each other in the widthwise direction of the river. The distal ends of these pipes 40 are supported by posts 42 which are placed upright with respect to the river bed so that a predetermined support strength can be maintained.

A method of application of the arch rubber dam according to the present embodiment and an operation thereof will be explained hereinafter.

First, after the overflow dam 14 has been built, the posts 42 are placed upright on the river bed. The pipes 40 bridge areas between the posts 42 and the summit portion 14A.

Next, the bag-shaped rubber sheet 12 is placed on the pipes 40. The seam portion 12A of the rubber sheet 12 is fixed to the summit portion 14A of the overflow dam 14 by the bolts 20, and the two end portions of the rubber sheet 12 are fixed to the side surfaces of the fixed dams 50.

In this way, since the rubber sheet 12 is placed on the pipes 40, when the two end portions of the rubber sheet 12 can be fixed to the side surfaces of the fixed dams, applicability of the arch rubber dam can be improved.

Figure 4:
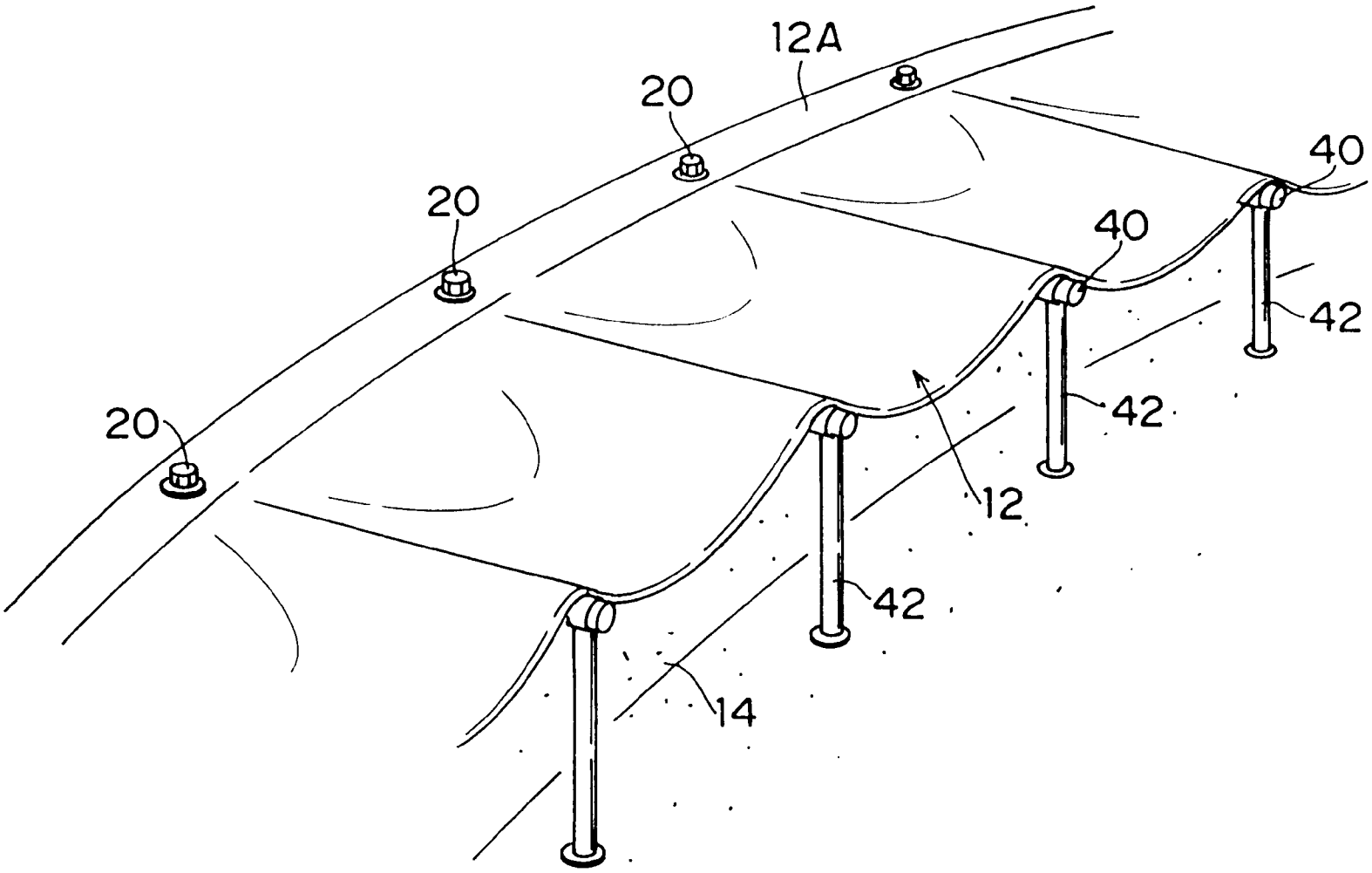
FIG. 4 is a perspective view illustrating a state in which the rubber dam according to the present embodiment has collapsed.
Figure 5:
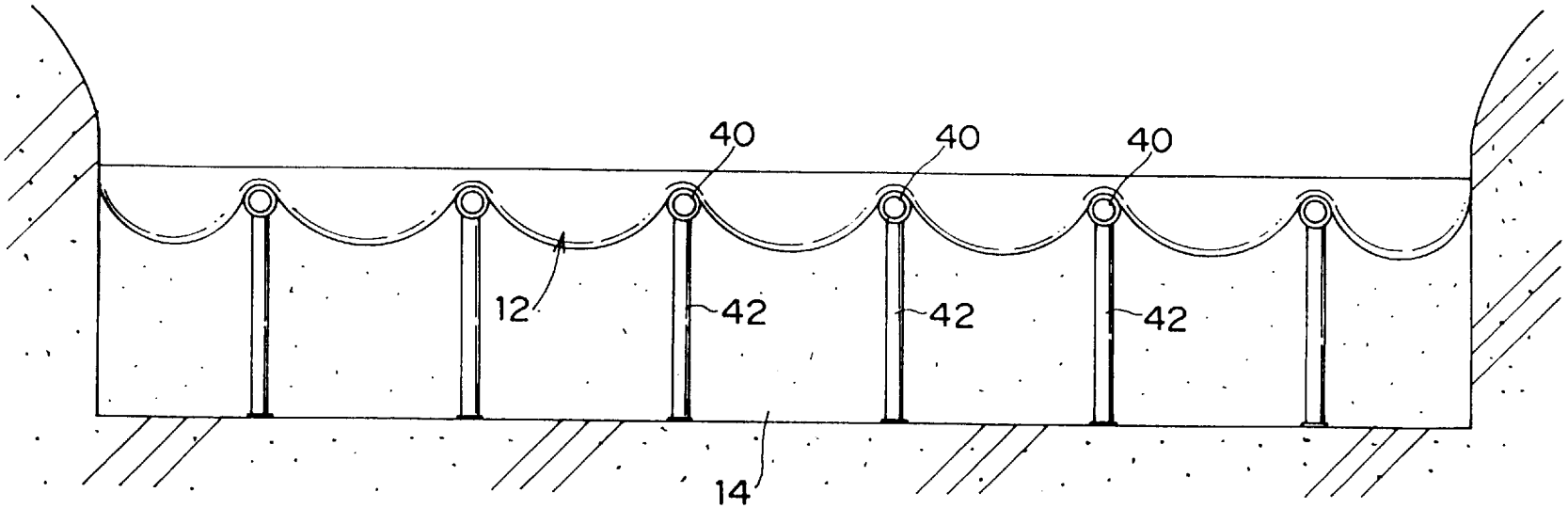
FIG. 5 is a front view illustrating a state in which the rubber dam according to the present embodiment has collapsed, as seen from the downstream side.

In such a structure as described above, when the bag-shaped rubber sheet 12 which has been expanded is contracted and collapsed, as shown in FIGS. 4 and 5, the rubber sheet 12 hangs down so as to droop down between the pipes 40 in a wave pattern (i.e., a so-called dragon wave) along the widthwise direction of the river. Accordingly, the rubber sheet 12 does not bulge at the downstream side and can thereby absorb slackness.

In the present embodiment, the height of the posts 42, or the diameter or pitch of the pipes 40 can be designed in accordance with the amount of overflowing water or with the width of the river. Further, it is possible to reduce the flow resistance which acts with respect to the rubber sheet 12 by disposing the pipes 40 on a downhill inclination toward the downstream side.

Figure 6:
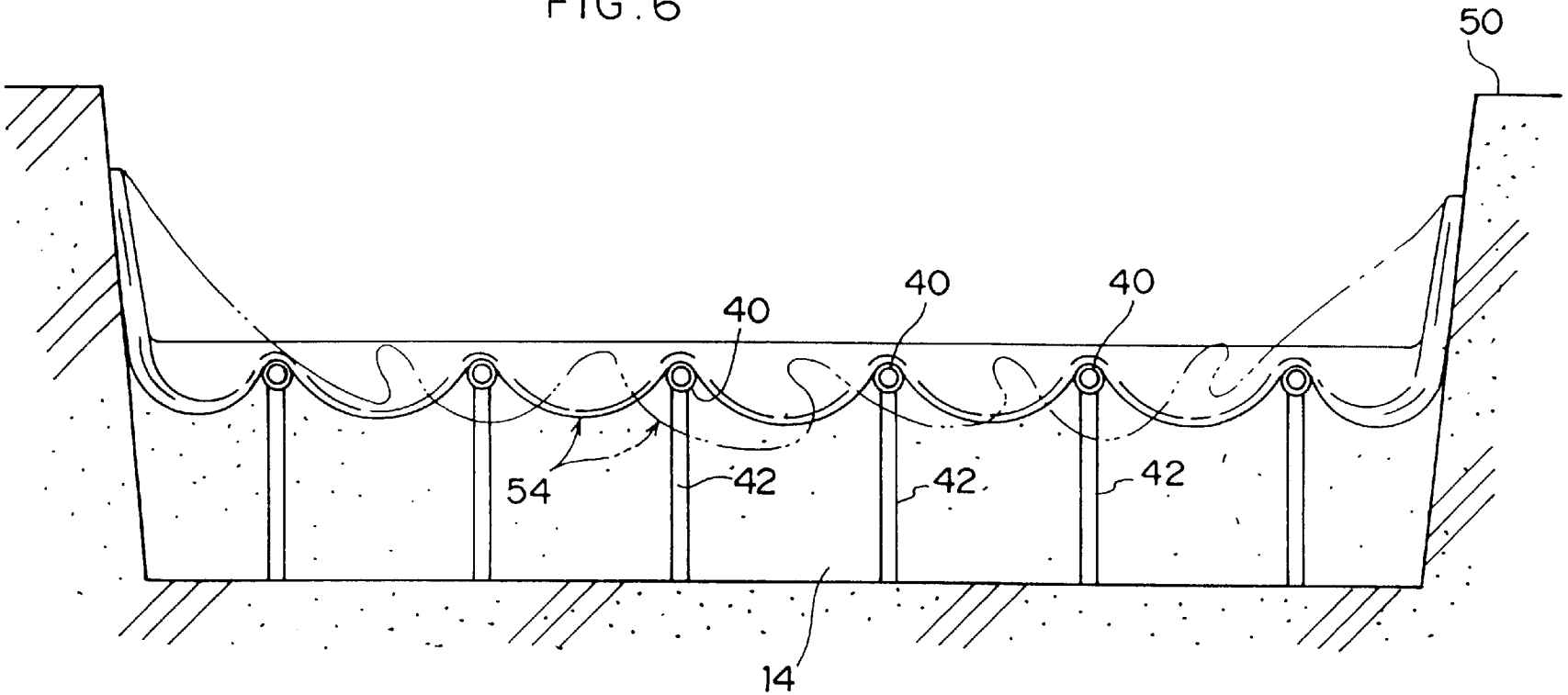
FIG. 6 is a front view illustrating a state in which a straight type rubber dam has collapsed, as seen from the downstream side.

In the present embodiment, an arch rubber dam has been explained. However, obviously, the present invention can be applied to a straight rubber dam. In a case of such a straight type rubber dam, as shown in FIG. 6, by providing the pipes 40, even when a rubber sheet 54 is contracted, the rubber sheet 54 does not sag down as indicated by the broken line and instead forms such a wave pattern as indicated by the solid line. Accordingly, when overflow occurs, it is possible to reduce the water pressure applied to the two end portions of the rubber sheet 54.

Figure 7:
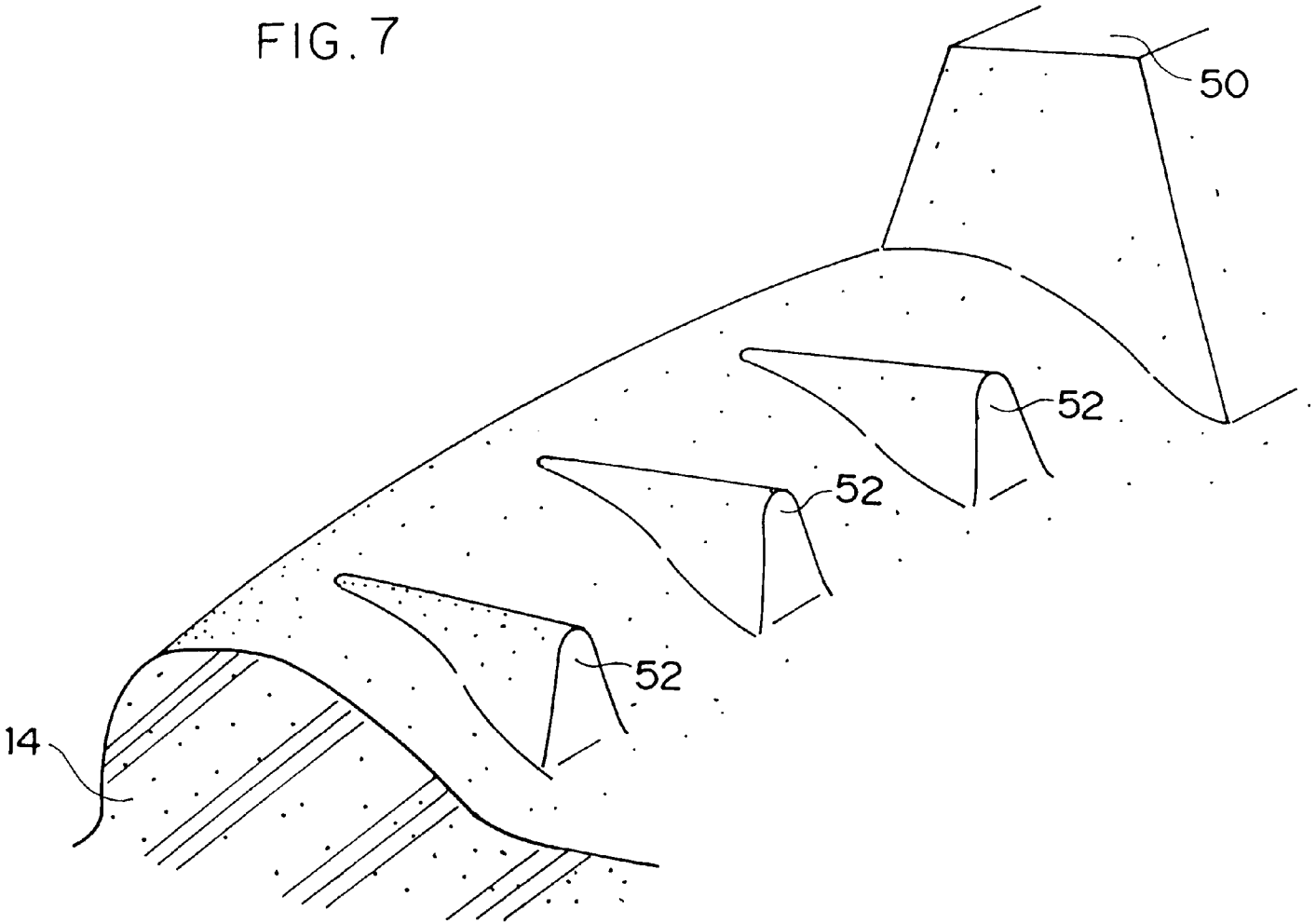
FIG. 7 is a perspective view illustrating a variant example of supports.
Figure 8:
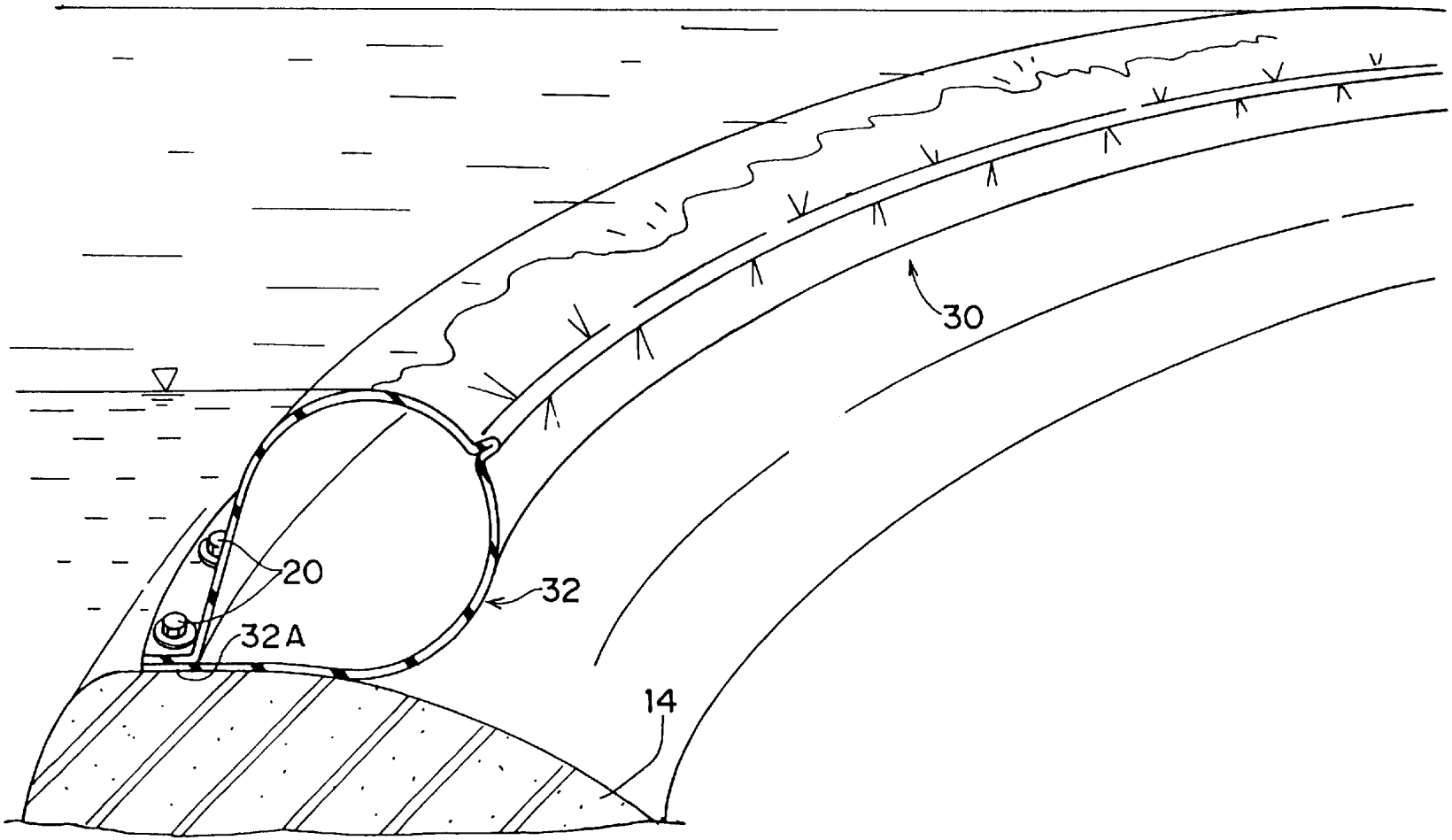
FIG. 8 RELATED ART
FIG. 8 is a perspective view illustrating a state in which a conventional rubber dam has risen.
Figure 9:
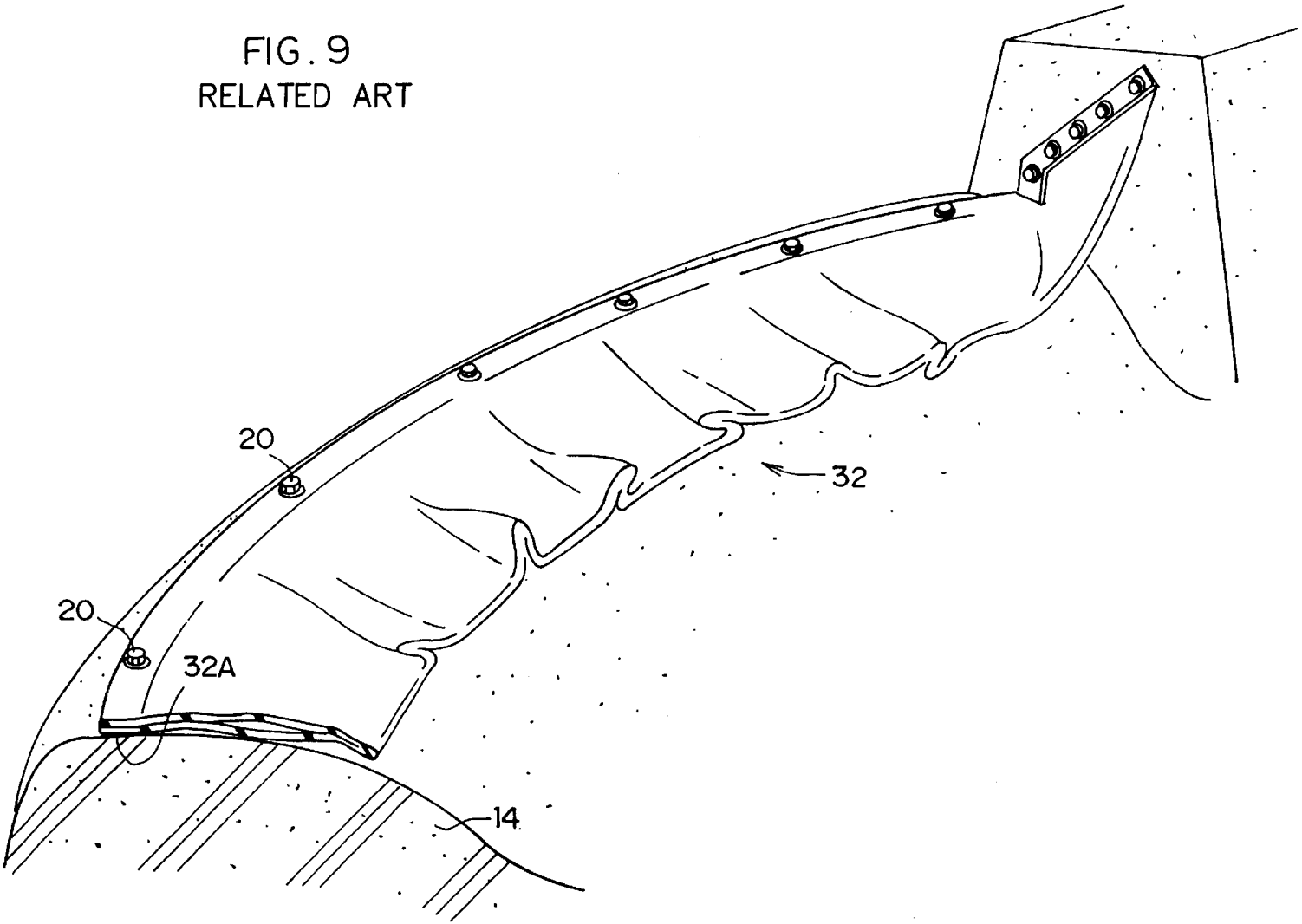
FIG. 9 RELATED ART
FIG. 9 is a perspective view illustrating a state in which a conventional arch rubber dam has collapsed.

In the present embodiment, the pipes 40 have been used as supports. However, the present invention is not limited to the same. As shown in FIG. 7, it is also possible to knock concrete into a slope of the overflow dam 14 to form wall bodies 52 provided at the downstream side whose summit portions are substantially parallel with the surface of the water. Further, a rubber dam to which the present invention can be applied is not limited to the rubber sheet that is doubled up. Instead, a rubber dam that is formed in a bag shape by connecting two end portions of two rubber sheets to each other, respectively, can be used.

What is claimed is:

1. A rubber dam that adjusts the amount of running water, comprising:

an overflow dam built on a river bed;

a rubber sheet formed in a bag shape;

a fixing portion at which said bag-shaped rubber sheet is fixed to a summit portion of said overflow dam; and supports which support said bag-shaped rubber sheet when it has been collapsed, extending substantially horizontally from the summit portion of said overflow dam toward the downstream side, at a predetermined distance from each other in the widthwise direction of the river.

2. A rubber dam according to claim 1, wherein two end portions of said rubber sheet are fixed to side surfaces of fixed dams.

3. A rubber dam according to claim 1, wherein said supports include pipes.

4. A rubber dam according to claim 1, wherein said supports are wall bodies that are knocked into a slope of said overflow dam at the downstream side, whose summit portions are substantially parallel with the water surface.

5. A rubber dam according to claim 1, wherein said supports are disposed with a downhill inclination toward the downstream side.

6. A rubber dam according to claim 1, wherein said bag-shaped rubber sheet is formed in a bag shape in which said rubber sheet is doubled up and overlapped.

7. A rubber dam according to claim 1, wherein said bag-shaped rubber sheet is formed such that two end portions of two rubber sheets are connected to each other.

8. A rubber dam according to claim 1, wherein said fixing portion is a seam portion of said rubber sheet.

9. A rubber dam according to claim 1, wherein a cord is embedded in said rubber sheet.

10. A rubber dam according to claim 1, wherein said cord is a reinforcement cord or a bias cord.

11. A method of application of a rubber dam that adjusts the amount of running water, comprising the steps of:

building an overflow dam on a river bed;

building supports which support a bag-shaped rubber sheet which has been collapsed, extending substantially horizontally from a summit portion of said overflow dam toward the downstream side, at a predetermined distance from each other in the widthwise direction of the river; and placing said bag-shaped rubber sheet on said supports and fixing said bag-shaped rubber sheet to the summit portion of said overflow dam.

12. A method of application of a rubber dam according to claim 11, further comprising a step of fixing two end portions of said rubber sheet to side surfaces of fixed dams.

13. A method of application of a rubber dam according to claim 11, wherein said supports include a pipe.

14. A method of application of a rubber dam according to claim 11, wherein said supports are wall bodies that are knocked into a slope of said overflow dam at the downstream side, whose summit portions are substantially parallel with the water surface.

15. A method of application of a rubber dam according to claim 11, wherein said supports are disposed with a downhill inclination toward the downstream side.

16. A method of application of a rubber dam according to claim 11, wherein said bag-shaped rubber sheet is formed in a bag shape in which the rubber sheet is doubled up and overlapped.

17. A method of application of a rubber dam according to claim 11, wherein said bag-shaped rubber sheet is formed in a bag shape in which two end portions of two rubber sheets are connected to each other.

18. A method of application of a rubber dam according to claim 11, wherein said fixing portion is a seam portion of said rubber sheet.

19. A method of application of a rubber dam according to claim 11, wherein said rubber sheet is a rubber sheet in which a bias cord is embedded.

20. A method of application of a rubber dam according to claim 11, wherein said rubber sheet is a rubber sheet in which a reinforcement cord is embedded.

* * * * *